US009756986B2

(12) United States Patent
Zimbric

(10) Patent No.: US 9,756,986 B2
(45) Date of Patent: Sep. 12, 2017

(54) CAULKLESS SEAL

(71) Applicant: Kohler Co., Kohler, WI (US)

(72) Inventor: Luke B. Zimbric, Sheboygan Falls, WI (US)

(73) Assignee: KOHLER CO., Kohler, WI (US)

( * ) Notice: Subject to any disclaimer, the term of this patent is extended or adjusted under 35 U.S.C. 154(b) by 36 days.

(21) Appl. No.: 14/922,818

(22) Filed: Oct. 26, 2015

(65) Prior Publication Data

US 2016/0045078 A1 Feb. 18, 2016

Related U.S. Application Data

(63) Continuation of application No. 13/829,994, filed on Mar. 14, 2013.

(51) Int. Cl.

| | |
|---|---|
| ***A47K 3/00*** | (2006.01) |
| ***A47K 3/08*** | (2006.01) |
| ***A47K 3/03*** | (2006.01) |

(52) U.S. Cl.

CPC ..... *A47K 3/08* (2013.01); *A47K 3/00* (2013.01); *A47K 3/008* (2013.01); *A47K 3/03* (2013.01)

(58) Field of Classification Search

CPC ..... A47K 3/284
USPC ..... 4/612
See application file for complete search history.

(56) References Cited

U.S. PATENT DOCUMENTS

2014/0250585 A1 9/2014 Slothower et al.

*Primary Examiner* — Lori Baker
(74) *Attorney, Agent, or Firm* — Foley & Lardner LLP

(57) ABSTRACT

A seal for a bathing enclosure includes a compliant member, a first member, and a second member. The compliant member includes opposing first and second sides defining a plurality of apertures. The plurality of apertures extend from the first side to the second side. The first member includes an inner surface configured to engage the first side of the compliant member. The second member includes an inner surface configured to engage the second side of the compliant member. A plurality of female members project from the inner surface of the first member through the plurality of apertures and a plurality of male members project from the inner surface of the second member through the plurality of apertures. The male members are configured to be received in the plurality of female members.

11 Claims, 9 Drawing Sheets

CAULKLESS SEAL

CROSS-REFERENCE TO RELATED PATENT APPLICATION

This application is a Continuation of U.S. patent application Ser. No. 13/829,994, filed on Mar. 14, 2013, the entire disclosure of which is incorporated herein by reference.

BACKGROUND

Prefabricated shower panel systems (e.g., assembly, surround, enclosure, etc.) generally include a series of wall panels (e.g., left, right, and back) and a base, such as a bathtub or a shower receptor. The wall panels are connected to (or otherwise intersect) each other along joints running generally vertically and to the base along joints running generally horizontally.

Water may leak out of panelized shower enclosures in various manners. For example, water may escape to behind the shower panels (e.g., to a building structure or cavity positioned behind the panels) by leaking through the joints between the panels and/or between the panels and the base. Water may also escape out a front or entry of the shower enclosure via the generally horizontal joint between left and/or right side panels, which may collect and provide a path parallel with the panel for water to travel forward and over a forward side of the base.

To prevent water leakage or escape, caulk or other curable liquid sealant is often applied to form a seal between the panels and the base. However, the effectiveness, longevity, and repeatability of achieving such a seal may be subject to the skill and experience of the installer and use of proper sealing material, among other considerations.

SUMMARY

According to an exemplary embodiment, a bathing enclosure includes a base, one or more wall panels, and a compliant member. The base includes a first flange extending outward from an upper end thereof to define an upper surface. The one or more wall panels include a second flange extending outward from a lower end thereof to define a lower surface. The compliant member has a length and a width, the length being greater than the width. The base and the one or more wall panels at least in part define a forward entrance into an interior of the enclosure. A generally horizontal interface is formed between the first flange and the second flange. The compliant member is coupled to a first of the one or more wall panels proximate the entrance. The compliant member forms a seal with the first flange, the length of the compliant member extending outward relative to the interior of the enclosure.

According to an exemplary embodiment, a bathing enclosure includes a basin, one or more wall panels, and a compliant member. The basin is a bathtub or shower receptor and includes an upper end. The one or more wall panels include a lower end configured to mount to the upper end of the basin to define an interior of the enclosure, the interior having a length and a width. The compliant member is coupled to the wall panel and sealingly engages the upper end of the basin. An upright plane extends generally parallel with the length of the interior at a forward decorative end of the one or more walls. The compliant member is entirely within a region extending rearward of the upright plane a distance equal to approximately 10% of the width of the enclosure.

According to an exemplary embodiment, a water management device is provided for a bathing enclosure having a base and one or more panels extending upward from the base to define an interior of the enclosure. The water management device includes a structure and a compliant member. The structure includes a first rigid member and a second rigid member, each rigid member having a bottom end and a rearward end. The compliant member is positioned between the first rigid member and the second rigid member, the compliant member extending below the bottom ends of the rigid members and rearward of the rearward ends of the rigid members.

DETAILED DESCRIPTION

According to an exemplary embodiment, a water management device or insert (e.g., caulkless seal, seal member, seal, etc.) is configured for preventing water from leaking out the front of a shower enclosure (e.g., assembly, surround, etc.). The enclosure generally includes a base (e.g., a bathtub or shower receptor) and one or more wall panels positioned on an upper end of the base, thereby forming a generally horizontal joint (e.g., interface, mating region, seam, etc.) therebetween. The water management device is coupled to a rear of the side panel (i.e., opposite the surface of the panel facing into the enclosure) near a bottom, outer corner. The water management device engages the upper end of the base to block or redirect water travelling within the horizontal joint toward the surround entrance (i.e., in the direction generally indicated by the arrow L in FIG. 1), such that water does not leak over a side of the base and/or is redirected inward to a basin.

Figure 1:
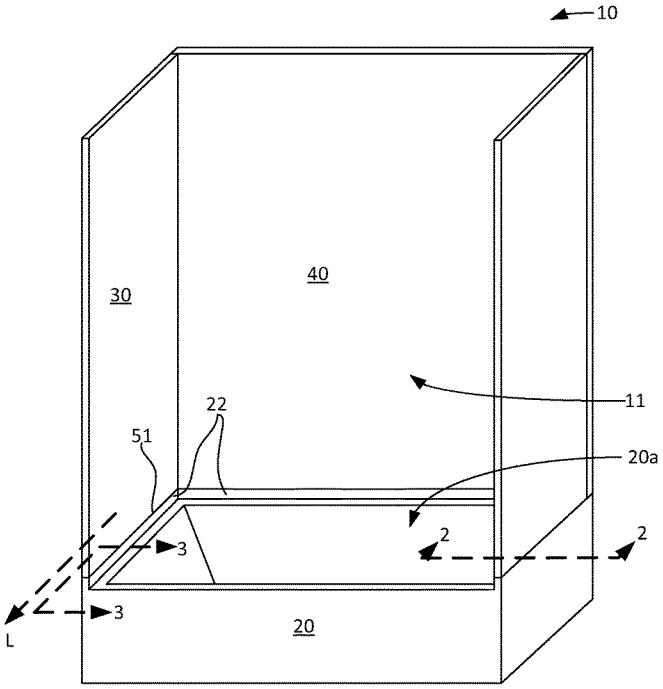
FIG. 1 is a an upper, front perspective view of a shower enclosure according to an exemplary embodiment.

As shown in FIG. 1, according to an exemplary embodiment, a shower enclosure 10 (e.g., assembly, surround, etc.) generally includes a base 20 (e.g., bathtub or shower receptor), and left and right upright side panels 30 (e.g., wall), a rear upright panel 40 (e.g., wall), and a water management device or seal 60. The side panels 30 and rear panel 40 are generally positioned above and coupled to the base 20 forming a perimeter joint 51 (e.g., seam, interface, coupling, etc.) therebetween. The seal 60 is coupled to one or more of the side panels 30 in a region generally adjacent an entrance 11 of the enclosure 10 and forms a seal with the base 20 to block and/or redirect water travelling in the joint 51 in a direction L.

The forward entrance 11 to the enclosure 10 is defined generally between the base 20 and at upright sides or ends of the side panels 30. More particularly, the entrance 11 is a generally vertical plane extending across a front of the enclosure and through which a person must pass to enter the basin 20*a* and enclosure 10. The vertical plane of the entrance 30 extends from the forwardmost (i.e., relative to the rear panel 40 of the enclosure 10) decorative surfaces of one or both of the side panels that are intended to be visible to a user after full installation of the enclosure 10 (i.e., the decorative surfaces do not include connective flanges or members, such as nail flanges, that may extend further forward from the side panel 30 but are intended to be covered after installation).

According to an exemplary embodiment, the base 20, side panels 30, and rear panel 40 may, for example, comprise a compression molded, thermoset material, or be formed from any other manufacturing process and/or material suitable for the uses described herein.

According to an exemplary embodiment, an upper end 21 of the base 20 is configured as a ledge or receptacle to receive a bottom end 31 of the side panel 30, such that a generally horizontal joint 51 is formed between a perimeter of the base 20 and the side panel 30. For example, the base 20 may include generally upright portions 22 (e.g., vertical or inclined walls, segments, etc.) having exposed inner surfaces (i.e., facing inward into the enclosure 10) that are positioned outward of and extend above a central basin 20*a*, for example, such that a shelf or ledge is positioned between the basin 20*a* and the upright portions 22. Instead, or additionally, the upper end 21 to which the side panels 30 are coupled may be positioned directly above a rim of the basin 20*a*.

Figure 2:
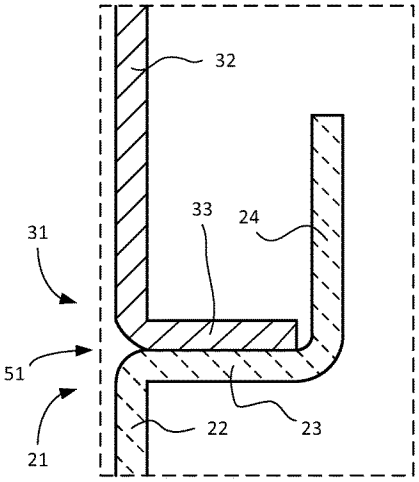
FIG. 2 is an upper, left side, partial cross-sectional view of a portion of a wall pane componentl and a base component of the shower enclosure as shown in FIG. 1.
Figure 3:
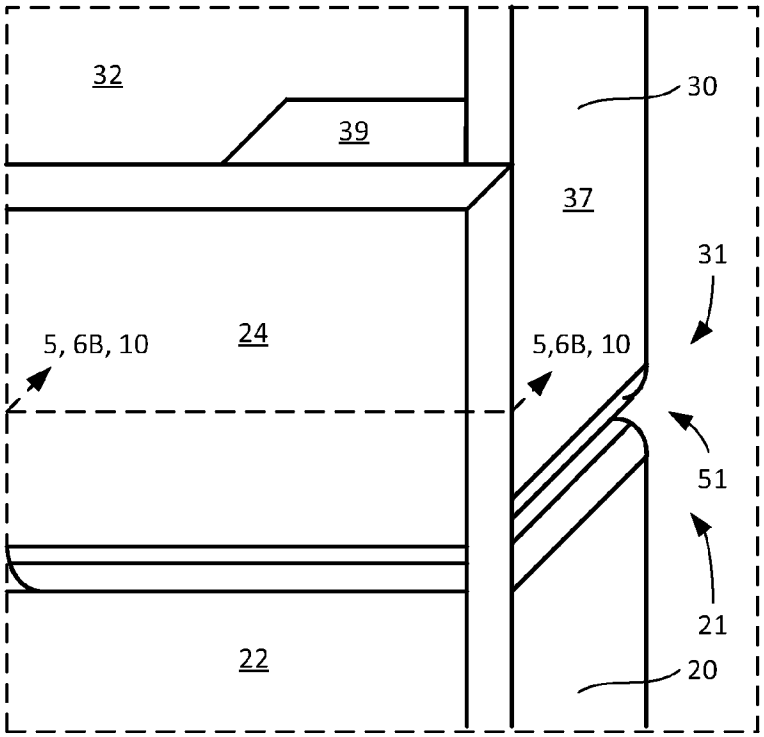
FIG. 3 is an upper, left side, partial perspective view the shower enclosure as shown in FIG. 1.

As shown in FIGS. 2-3, according to an exemplary embodiment, the upper end 21 includes an outwardly protruding flange 23, which extends outward from the upright portions 22 at the upper perimeter of the base 20. The outwardly protruding flange 23 may be generally horizontal (as shown), or may extend outward with an incline, such that water thereon will drain inward toward the basin 20*a*, or other fixed or varying angle. An upwardly protruding flange 24 extends upward from the outwardly protruding flange 23 and is positioned outward of the upright side portion 22. The upwardly protruding flange 24 may be generally vertical (as shown), or may extend upward with an outward incline, such that water thereon will drain downward and inward to the outwardly protruding flange 23, or other fixed or varying angle.

In cross-section, the outwardly protruding flange 23 and upwardly protruding flange 24 form an L-shape extending outward from the upright portion 22 of the base 20. The outwardly protruding flange 23 forms a ledge (e.g., platform, structure, surface, etc.) onto which the lower end of the side panels 30 may be positioned. Collectively, the outwardly protruding flange 23 and upwardly protruding flange 24 define a recess (e.g., L-shaped recess) for receiving the lower end 31 of the side panel 30.

As shown in FIG. 2-3, according to an exemplary embodiment, each side panel 30 includes a generally upright portion 32 (e.g., vertical or inclined wall, segment, etc.), which along with a generally upright portion 42 of the rear panel 40, include forward or exposed faces that generally define an interior of the shower enclosure 10. Each upright portion 32 terminates at the bottom or lower end 31. The lower end 31 includes an outwardly protruding flange 33, which extends outward from the generally upright portion 32 of the side panel 30. The outwardly protruding flange 33 may extend outward at an angle or profile corresponding to that of the outwardly protruding flange 23 of the base 20, such that opposing surfaces of the outwardly protruding flanges 23, 33 may be in contact (i.e., engage, interface, mate, couple, etc.) with each other.

In cross-section, the outwardly protruding flange 33 and the upright portion 32 of the side panel 30 form an L-shape. The outwardly protruding flange 33 forms a bottom resting surface or structure (e.g., member, segment, etc.) that is configured rest on the outwardly protruding flange 23 of the base 20, thereby forming a joint therebetween (i.e., seam, interface, coupling, etc.). Further, an outer end of the outwardly protruding flange 33 is positioned inward of the upwardly protruding flange 24 of the base 20, allowing the upright portions 22, 32 of the base 20 and the side panel 30, respectively, to be in desired relative position (e.g., with inner surfaces thereof being outward, inwardly, or generally even therewith in one or more regions around the perimeter of the base 20).

As shown in FIGS. 4 to 6B, a seal 60 is configured to couple to the side panel 30 proximate the entrance 11 of the enclosure 10. The seal 60 includes a compliant member 61 (e.g., seal member, gasket, etc.) having a lower surface 61*a* that is configured to engage and form a seal with an upper surface of the outwardly extending flange 23 of the base 20. More particularly, the compliant member 61 extends rearward (i.e., outwardly or away from the basin 20*a* or interior of the enclosure 10) and engages substantially the entire width of the outwardly extending flange 23 (e.g., as measured from the upright portion 22). For example, the compliant member 61 may extend rearward a sufficient distance to additionally engage the upwardly extending flange 24. The compliant member 61 may also include a rearward surface 61*b* that is configured to engage and form a seal with a forward surface of the upwardly extending flange 24 of the base 20. By being positioned proximate or adjacent the entrance 11 and by forming a seal with the outwardly extending flange 23 and/or upwardly extending flange 24 of the base 20, the seal 60 prevents water from migrating in a direction L through the joint 51 formed between the base 20 and side panel 30. Instead, water will be blocked by the seal 60 and/or redirected inward toward the basin 20*a*.

According to an exemplary embodiment, the compliant member 61 of the seal 60 may be positioned entirely within a small or distance as measured horizontally rearward from the entrance 11, or other reference point proximate the entrance 11 (e.g., upright end of the side panel 30, forwardmost decorative or normally exposed surface face of the side panel 30, forwardmost portion of the rim of the basin 20*a*, forwardmost contact point between the base 20 and side panel 30, forward face of the tub, etc.). For example, the compliant member 61 may be positioned entirely within a horizontal distance of the entrance 11 or other aforementioned point equal to approximately 10% of the overall width of the side panel 30 (e.g., within approximately 5%), approximately 2 inches (e.g., approximately 1.25 inches), and/or between the forward surface of the base 20 and a perimeter edge of the basin 20*a*.

According to an exemplary embodiment, the compliant member 61 may, for example, be a closed cell foam, such as neoprene, EPDM, or a combination thereof. According to other exemplary embodiments, the compliant member 61 is made from any other suitable resiliently compressible material, as will be recognized by those skilled in the art suitable for the described use herein.

According to an exemplary embodiment, the side panel 30 and the seal 60 are cooperatively configured for the compliant member 61 to compress against the outwardly extending flange 23 of the base 20 without forming a gap between the base 20 and the side panel 30. This is in contrast to placement of a gasket or other sealing material directly between the outwardly extending flanges 23, 33, which would raise the side panel 30 above the base 20. For example, the outwardly extending flange 33 may be discontinuous (e.g., have a slot or cutout 35) or terminate prior to an upright flange 37 (described in further detail below) or other end of the upright portion 32 of the side panel 30. The compliant member 61, thereby, may extend downward from a position above to a position below the outwardly extending flange 33 of the side panel 30 to engage the outwardly extending flange 23 of the base 20. In this manner, the compliant member 61 is compressed against the upper surface of the outwardly extending flange 23 of the base 20 to form a seal therewith, but is not compressed between otherwise interfacing portions of the outwardly extending flanges 23, 33 and does not form a gap therebetween.

According to an exemplary embodiment, the seal 60 is configured to couple to a rear portion of the side panel 30. More particularly, the side panel 30 includes a receptacle 36 (e.g., cavity, channel, structure, female member, etc.), and the seal 60 includes a base structure 62 (e.g., member, portion, body, etc.) that is received within the receptacle 36.

Figure 5:
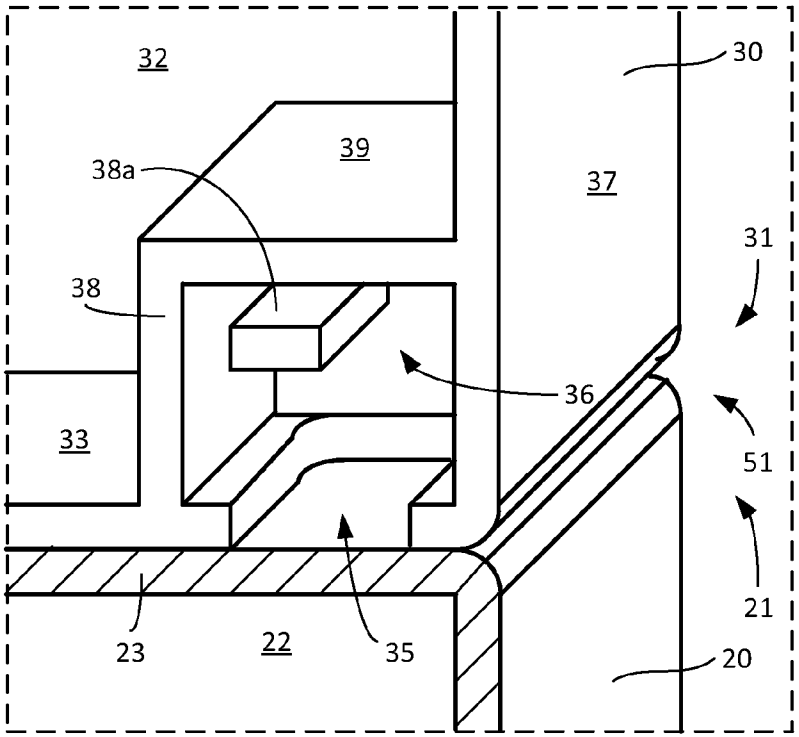
FIG. 5 is an upper, left side, partial cross-sectional perspective view of the shower enclosure as shown in FIG. 1 without a water management device.
Figure 7:
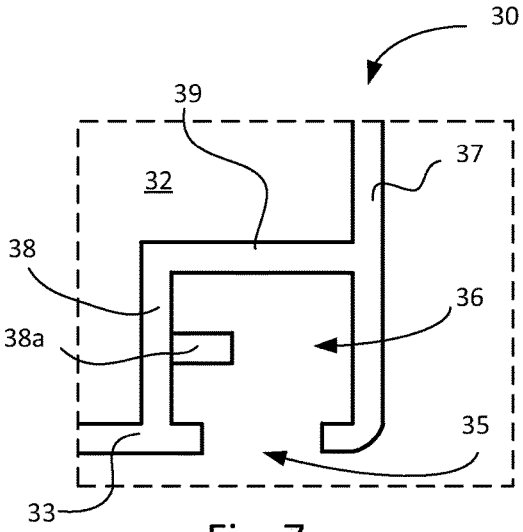
FIG. 7 is a left side, partial plan view of a portion of a wall panel of the shower enclosure as shown in FIG. 1.

As shown in FIGS. 5-7, according to an exemplary embodiment, the receptacle 36 extends rearward from the upright portion 32 of the side panel 30 and is generally open in a rearward direction (i.e., outward relative to the basin 20*a*). For example, the receptacle 36 may have a generally rectangular or square opening, as well as a generally rectangular or square cross-section. The inner surfaces of the receptacle 36 may, for example, include a forward, upper, and two side surfaces. The forward surface of the receptacle 36 may, for example, be formed by a rearward surface of the upright portion 32 of the side panel 30. A first of the side surfaces may, for example, be an inner surface of an upright flange 37 (e.g., protrusion, projection, member, extension, body, etc.) that extends in a direction away from and/or opposed to the upright portion 32. The flange 37 may, for example, form the forwardmost surface of the side panel 30 that defines the generally vertical plane of the entrance 11. A second of the side surfaces may, for example, be defined by an upright flange 38 (e.g., protrusion, projection, member, extension, body, etc.) extending away from the upright portion 32 at a position spaced apart from the flange 37. The upper surface may be defined by an outwardly extending flange 39 (e.g., protrusion, projection, member, extension, body, etc.) extending away from the upright portion 32 of the side panel 30 at a higher elevation the outwardly extending flange 33. Additionally, the outwardly extending flange 33 may further define a lower surface of the receptacle 36 and define or include the slot 35. Collectively, the upright flange 37, upright flange 38, upper outwardly extending flange 39, and the reawardly extending flange 33 cooperatively define, and may be coupled to each other to form, the generally rectangular receptacle for receiving the seal 60 therein.

According to other exemplary embodiments, the receptacle 36 may be configured in other manners (e.g., being spaced apart from the entrance 11, being spaced rearward from the upright portion 32, having non-rectangular cross section and/or opening, etc.).

Figure 4:
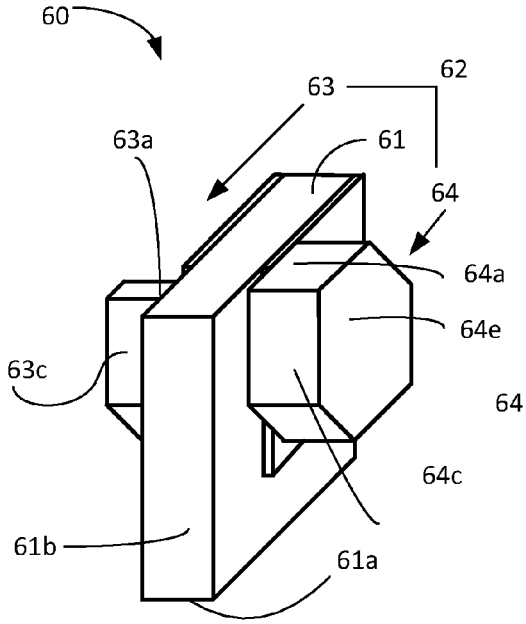
FIG. 4 is an upper, rear perspective view of a water management device according to an exemplary embodiment.
Figure 4A:
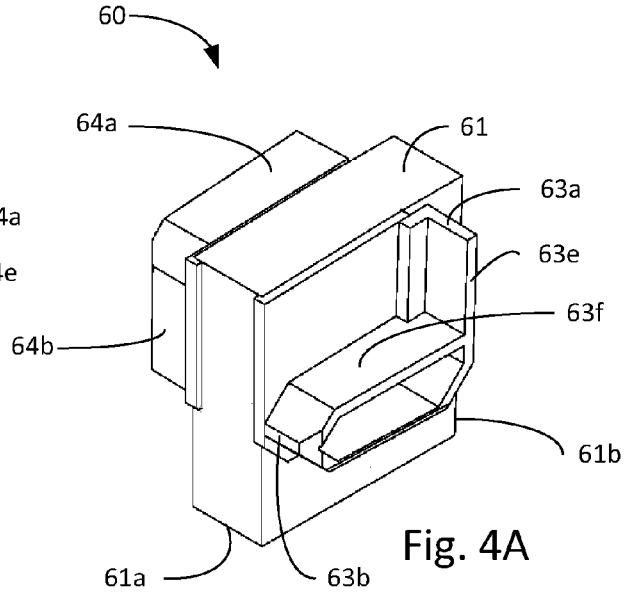
FIG. 4A is an upper, front perspective view of a water management device according to an exemplary embodiment.
Figure 4B:
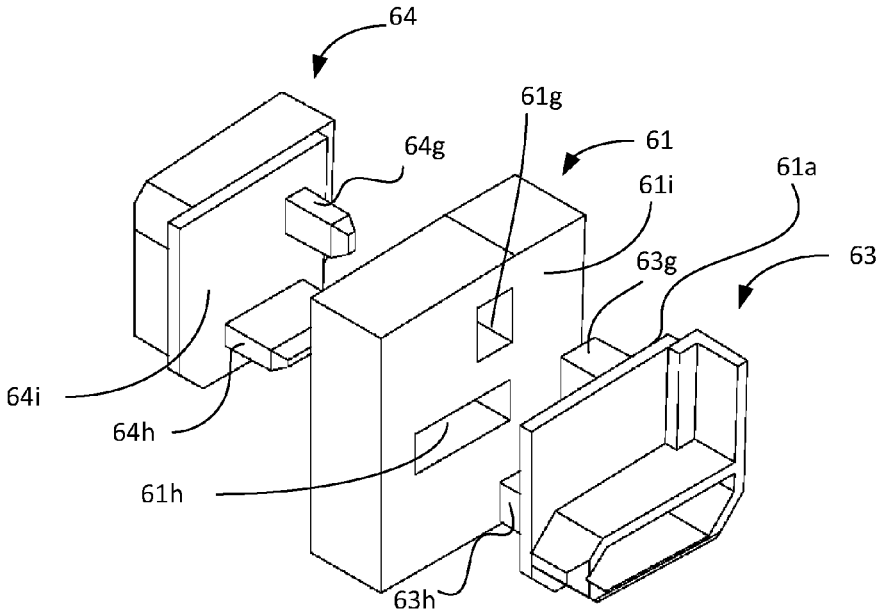
FIG. 4B is an upper, front, exploded perspective view of the water management device as shown in FIG. 4A.
Figure 6B:
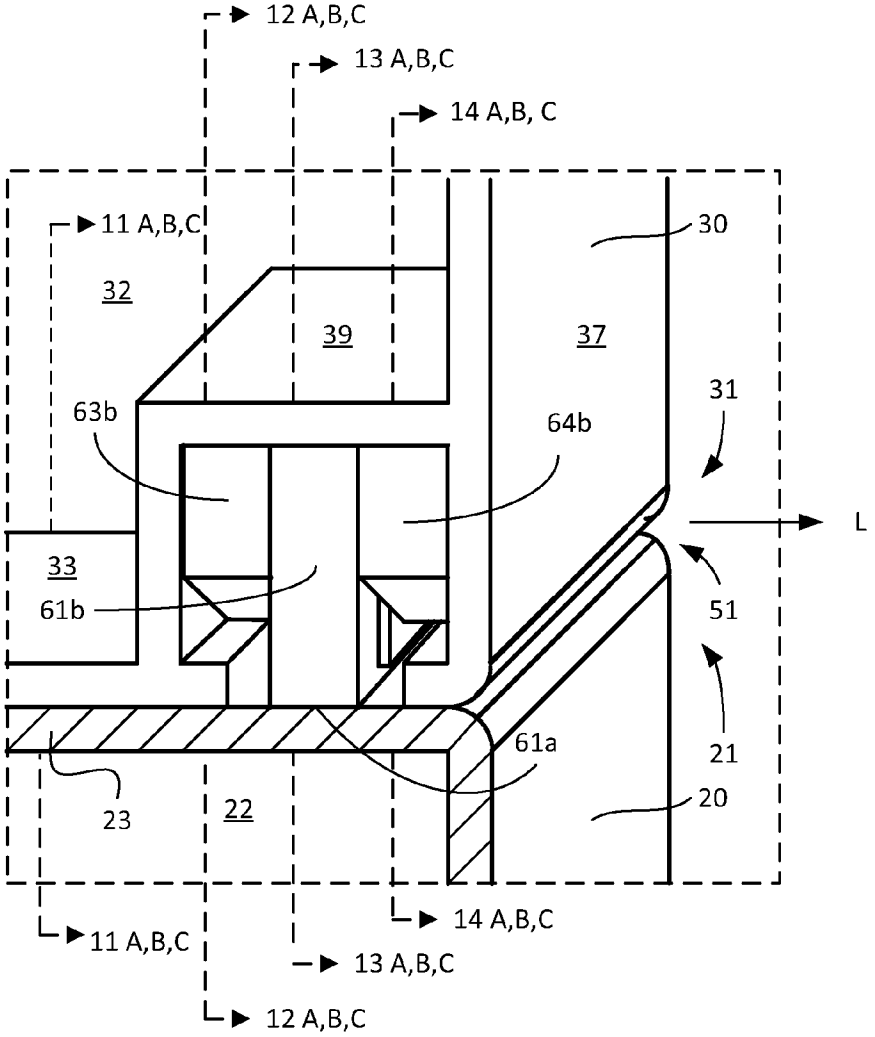
FIG. 6B is an upper, rear, partial cross-sectional perspective view of the shower enclosure as shown in FIG. 1.
Figure 6A:
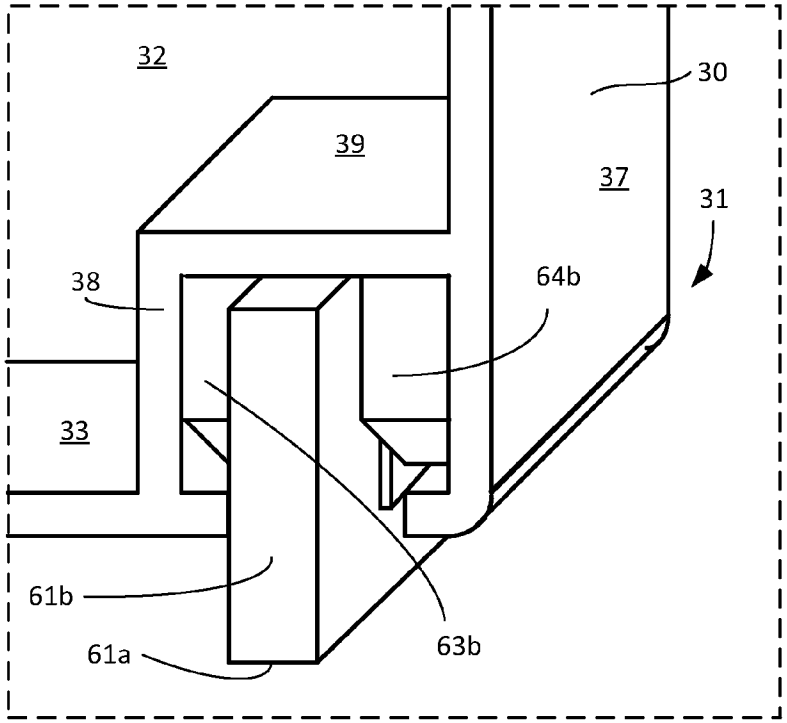
FIG. 6A is an upper, left side perspective view of a portion of a wall panel and a water management device of the shower enclosure as shown in FIG. 1.
Figure 8:
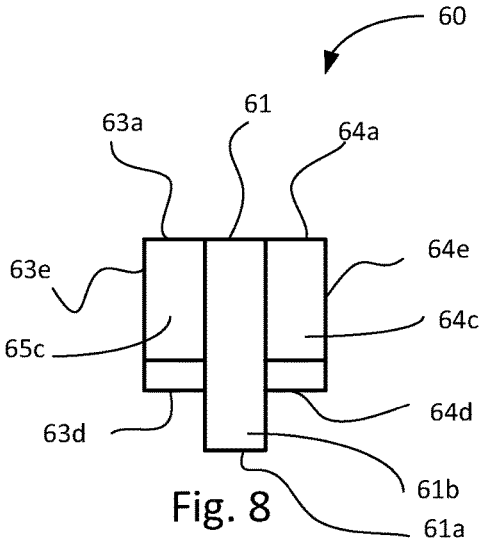
FIG. 8 is a rear plan view of the water management device as shown in FIG. 4.
Figure 9:
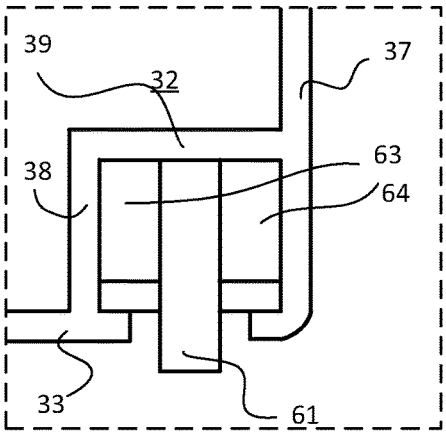
FIG. 9 is a left side, partial plan view of a wall panel and a water management device of the shower enclosure as shown in FIG. 1.
Figure 10:
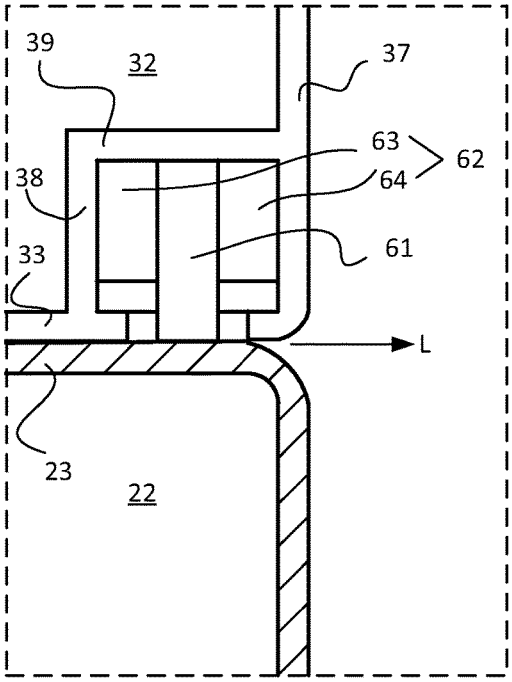
FIG. 10 is a left side, partial cross-sectional view of the shower enclosure as shown in FIG. 1.
Figure 11C:
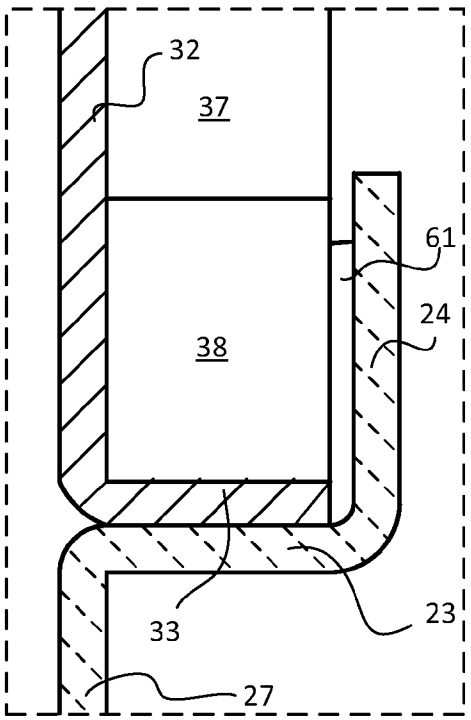
FIG. 11C is a partial cross-sectional view of a the shower enclosure as shown in FIG. 1 taken from Line 11C-11C in FIG. 6B.
Figure 11B:
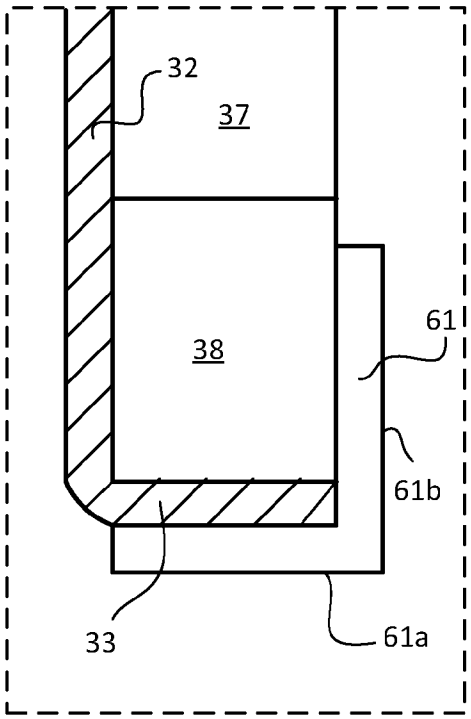
FIG. 11B is a partial cross-sectional view of a wall panel component and a water management device of the shower enclosure as shown in FIG. 1 taken from Line 11B-11B in FIG. 6B.
Figure 11A:
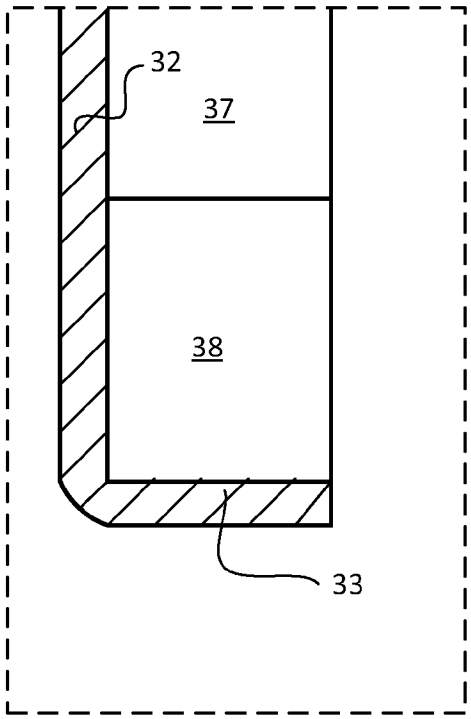
FIG. 11A is a partial cross-sectional view of a wall panel component of the shower enclosure as shown in FIG. 1 taken from Line 11A-11A in FIG. 6B.
Figure 12C:
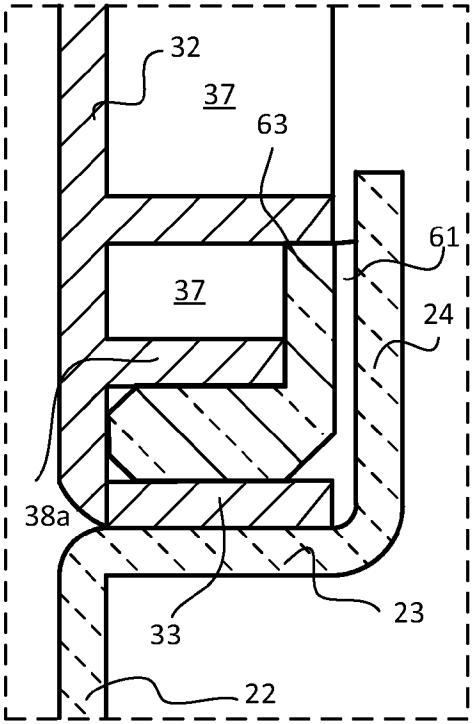
FIG. 12C is a partial cross-sectional view of a the shower enclosure as shown in FIG. 1 taken from Line 12C-12C in FIG. 6B.
Figure 12B:
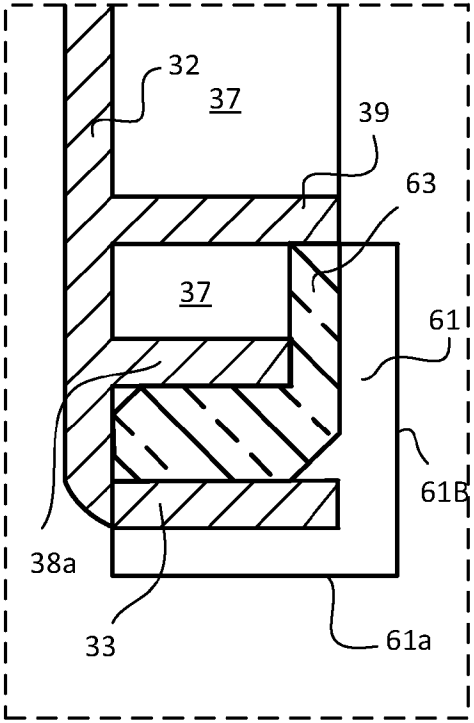
FIG. 12B is a partial cross-sectional view of a wall panel component and a water management device of the shower enclosure as shown in FIG. 1 taken from Line 12B-12B in FIG. 6B.
Figure 12A:
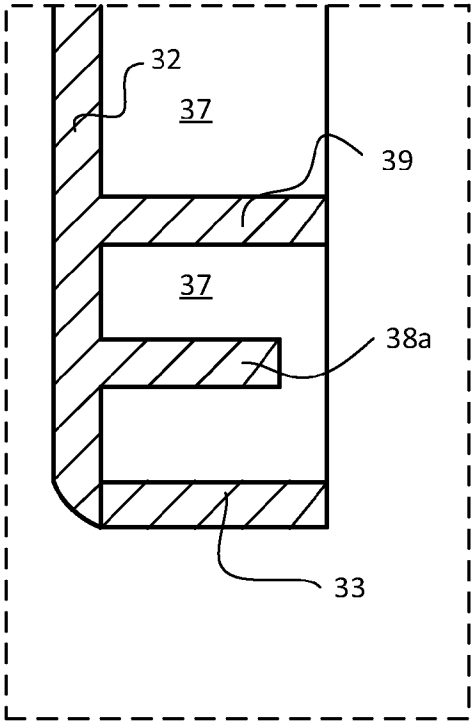
FIG. 12A is a partial cross-sectional view of a wall panel component of the shower enclosure as shown in FIG. 1 taken from Line 12A-12A in FIG. 6B.
Figure 13C:
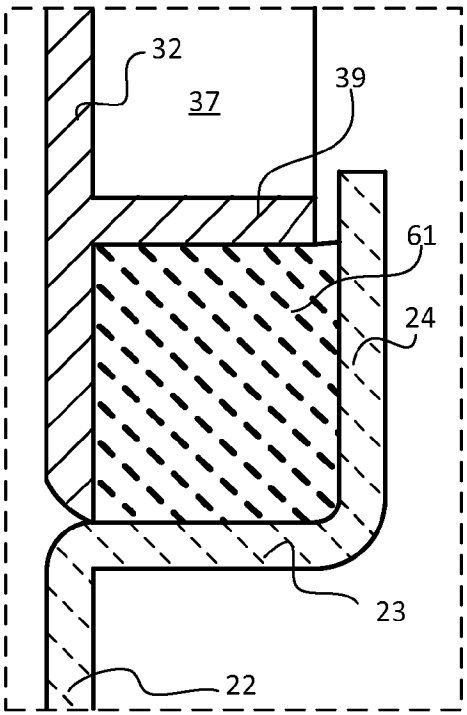
FIG. 13C is a partial cross-sectional view of a the shower enclosure as shown in FIG. 1 taken from Line 13C-13C in FIG. 6B.
Figure 13B:
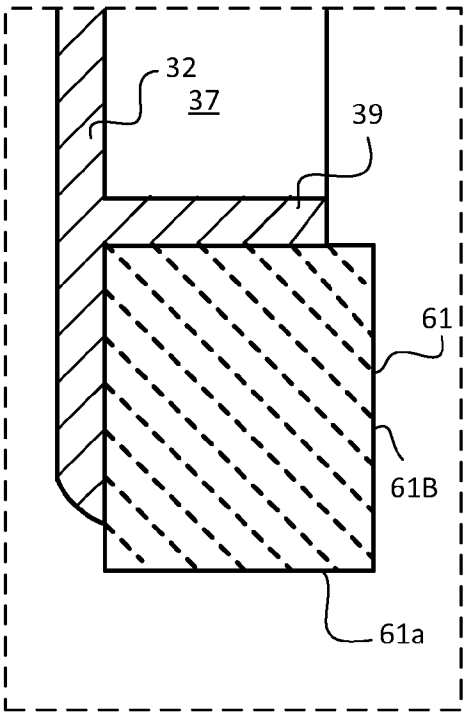
FIG. 13B is a partial cross-sectional view of a wall panel component and a water management device of the shower enclosure as shown in FIG. 1 taken from Line 13B-13B in FIG. 6B.
Figure 13A:
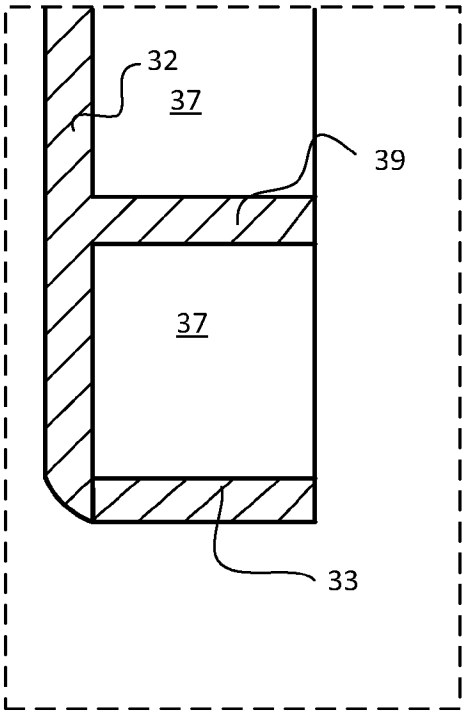
FIG. 13A is a partial cross-sectional view of a wall panel component of the shower enclosure as shown in FIG. 1 taken from Line 13A-13A in FIG. 6B.
Figure 14C:
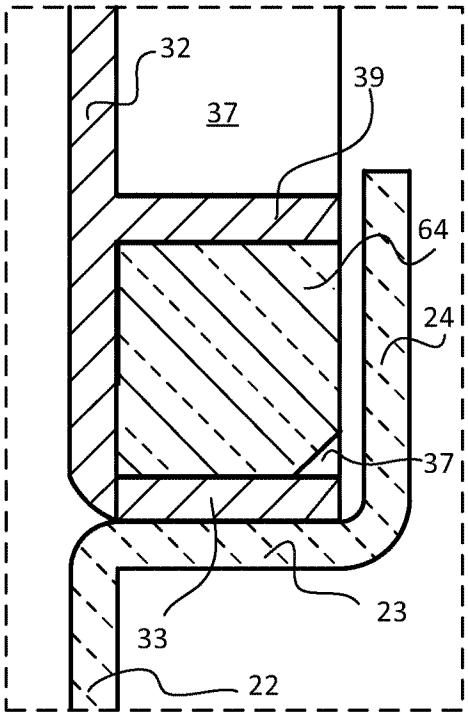
FIG. 14C is a partial cross-sectional view of a the shower enclosure as shown in FIG. 1 taken from Line 14C-14C in FIG. 6B.
Figure 14B:
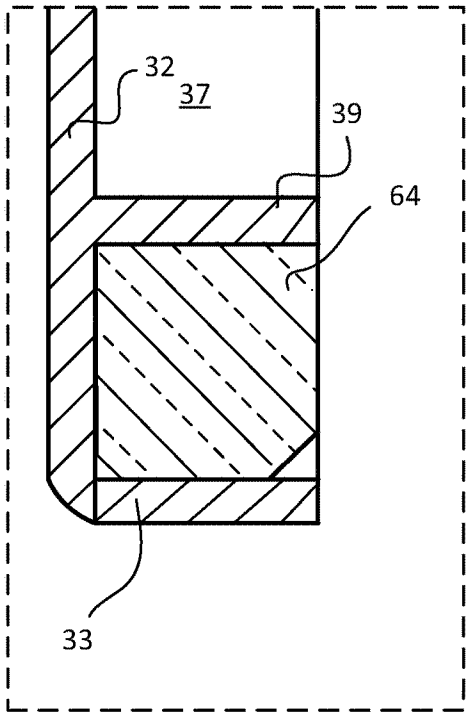
FIG. 14B is a partial cross-sectional view of a wall panel component and a water management device of the shower enclosure as shown in FIG. 1 taken from Line 14B-14B in FIG. 6B.
Figure 14A:
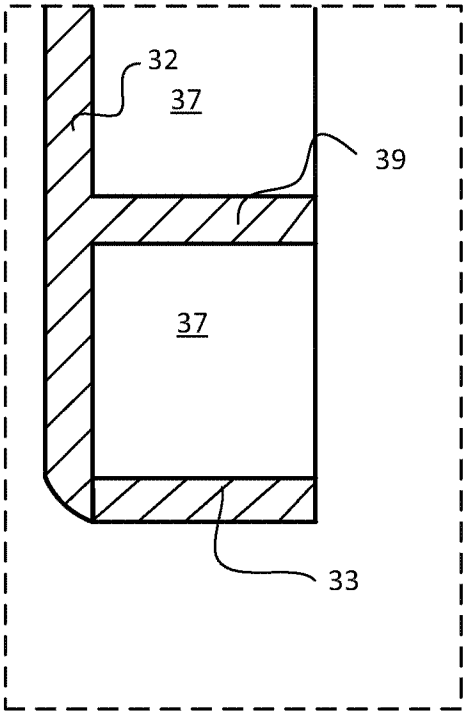
FIG. 14A is a partial cross-sectional view of a wall panel component of the shower enclosure as shown in FIG. 1 taken from Line 14A-14A in FIG. 6B.

As shown in FIGS. 4-4B and 8, according to exemplary embodiments, the seal 60, and in particular the base structure 62, is configured to be received within the receptacle 36 for coupling to the side panel 30. For example, the base structure 62 defines surfaces or engaging portions that are configured to engage the inner surfaces of the receptacle 36 (e.g., upper, lower, and side) for a press- or friction-fit coupling therebetween. According to other exemplary embodiments, the seal 60 is coupled to the receptacle 36 or panel 30 in other manners including, for example, complementary integrally formed positive engagement features (e.g., tabs, hooks, recesses, apertures, etc.), fasteners, adhesives, etc.

According to an exemplary embodiment, the base structure 62 includes a first member 63 and a second member 64, which are disposed on either side of the compliant member 61 and are configured to couple to each other. Each member 63, 64 may, for example, be an injection molded plastic component, or may be made according to any other manufacturing process and/or material suitable for the uses described herein.

According to an exemplary embodiment, the first member 63 and the second member 64 each define upper surfaces 63*a*, 64*a*, forward surfaces 63*b*, 64*b*, lower surfaces 63*d*, 64*d*, and opposing outer side surfaces 63*e*, 64*e*, respectively, which engage the corresponding upper, forward, lower, side surfaces of the receptacle 36. Rearward surfaces 63*c*, 64*c* are exposed at the opening of the receptacle 36. While the surfaces are depicted in FIG. 4 as being generally continuous (e.g., solid), it is further contemplated that, as shown in FIGS. 4A-4B, the first member 63 and second member 64 may include recesses such that the outer surfaces 63*a*, 64*a* are formed at a peripheral edge of the members 63, 64 (e.g., such that narrow edges engage the side surfaces of the receptacle 36). The members 63, 64 may include chamfers, tapers, or eased edges between surfaces and/or the surfaces may taper or narrow downward or inwardly (i.e., in the direction toward the forward end or surfaces 63*c*, 64*c* of the seal 60), for example, to aid insertion and/or retention of the seal 60 into the receptacle 36.

According to an exemplary embodiment, the receptacle 36 may further include an internal projection or segment 38*a* extending partially inward from the upright flange 38 and/or the upright portion 32. The internal segment 38*a* defines a lower surface under which a second upper surface 63*f* of the member 63 is configured to be positioned, for example, to couple the member 63 to the side panel 30 between the internal segment 38*a* and the outwardly projecting flange 33 adjacent the channel 35 (e.g., such that the member 63 is wedged or press-fit between the internal segment 38*a* and the flange 33). According to other exemplary embodiments, the segment 38*a* may be configured in other manners (e.g., extending from other surfaces and/or engaging a portion of the member 63 or 64).

According to an exemplary embodiment, the first member 63 and the second member 64 are configured to couple to each other with the compliant member positioned therebetween. For example, the first member 63 includes inwardly projecting female projection 63*g*, 63*h* that are configured to receive opposing projecting male members 64*g*, 64*h*. The female and male members are configured to couple to each other (e.g., through friction-, press-, or tolerance-fit, integrally-formed positive coupling features, and/or adhesives, etc.). The female and male members my further be configured to define an overall width of the seal 60 between outer surfaces 63*e*, 64*e* of the members 63, 64, for example, by having ends of the female and male members engage the members 63, 64 (e.g., inners surfaces or flanges 63*i*, 64*i*, respectively). It should be noted that the female members 63*g*, 63*h* and male members 64*g*, 64*h* are not depicted in the cross-sectional FIGS. 12B, 12C, 14B, and 14C.

According to an exemplary embodiment, the compliant member 61 includes apertures 61*g*, 61*h* that are configured to receive the female members 63*g*, 63*h* and male members 64*g*, 64*h*. The members 63, 64 each include inner surfaces 63*i*, 64*i* (e.g., flanges, plates, planes, etc.) that face, are adjacent to, and/or may abut or engage outer surfaces 61*i* of the compliant member 61. For example, the spacing between the inner surfaces 63*i*, 64*i* of the members 63, 64 (e.g., from cooperative lengths of the female members 63*g*, 63*h* and male members 64*g*, 64*h*) may be less than an uncompressed width of the compliant member 61, such that the compliant member 61 is compressed between the members 63, 64 to be held therebetween. According to other exemplary embodiments, the spacing may be generally equal to or greater than the width of the compliant member 61.

Configured in these manners, the compliant member 61 may be coupled to the structural member 62 without the use of fasteners or adhesives, which may be advantageous for a assembly purposes and/or may allow the compliant member 61 to slide between the inner surfaces 63*i*, 64*i* of the members 63,64 to provide additional height for the compliant member 61 to compress without causing a gap between the side panel 30 and the base 20 (e.g., as compared to the surface of the compliant member being glued to the members 63, 64).

According to an exemplary embodiment, the bottom female member 63*h*, bottom male member 64*h*, and corresponding aperture 61*h* are elongated rearward or outward relative to the basin 20*a* (e.g., forming a generally rectangular or oblong shape). The elongated surface may, advantageously, apply a more evenly distributed downward force against the compliant member 61, so as to achieve more even pressure distribution of the lower surface 61 a of the compliant member 61 against the outwardly extending flange 23 of the base 20 and/or to prevent localized permanent deformation (e.g., tearing) of the compliant member. For example, the female member 63*h* and/or the aperture 61*h* may have a width that is greater than approximately 25% of the total length of the compliant member 61 (e.g., greater than approximately 40%).

According to an exemplary embodiment, the compliant member 61 extends downward from a bottom end of the base structure 62 a sufficient distance (i.e., greater than the thickness of flange 33), so as to extend downward through the channel 35 to engage the outwardly extending flange 23 of the base 20. For example, the compliant member 61 may have a height that provides for the compliant member 61 to extend below the flange 33 a distance greater than approximately one time the thickness of the flange 33 (e.g., greater than approximately 1.5 times). The compliant member 61 may further extend away from a rear end of the base structure 62 a sufficient distance to engage the upwardly extending flange 24 of the base 24. For example, the compliant member 61 may have a length that provides for the compliant member 61 to extend behind the receptacle 36 a distance greater than approximately one time the thickness of the flange 33 (e.g., greater than approximately 1.5 times).

Configured in these manners, when each side panel 30 is coupled to the base 20 (i.e., when lower and upper ends 31, 21 thereof, respectively, mate to form joint 51 therebetween), the compliant member 61 forms a seal with the outwardly projecting flange 23 and/or the upwardly projecting flange 24 of the base 20. The compliant member 61 functions to prevent block and/or redirect water that may be travelling in the joint 51 (e.g., between the outwardly depending flanges 23, 33 of the base 20 and side panel 30, respectively) to prevent water from leaking outside the enclosure 10 in a direction L.

Assembly of the enclosure 10 is further illustrated in FIGS. 5-14C. In particular, coupling of the seal 60 to the side panel 30 and the spatial relationships of the compliant member 61 and base structure 62 to the various flanges or surfaces of the side panel 30 and base 20 are depicted in these figures. FIGS. 5 (rear upper perspective view), 7 (rear plan view), and 11A, 12A, 13A, and 14A (outward cross-sectional views) depict the side panel 30 prior to insertion of the seal 60 into the receptacle 36. FIGS. 6A (rear upper perspective view), 9 (rear plan view), and 11B, 12B, 13B, and 14B (forward facing cross-sectional views) depict the side panel 30 after the seal 60 has been inserted into the receptacle 36 of the side panel 30 prior to positioning of the side panel 30 onto the base 20. FIGS. 6B (rear upper perspective view), 10 (rear plan view), and 11C, 12C, 13C, and 14C (outward cross-sectional views) depict the side panel 30 after the seal 60 has been inserted into the receptacle 36 and after the side panel 30 has been positioned on the base 20, such that the compliant member 61 is compressed upward and inward by the flanges 23, 24, respectively, of the base 20. As shown in FIGS. 6A and 6B, cross-sectional views having the suffix A are taken from inward of the receptacle 36, having the Suffix B are taken through the seal structural member 63, having the Suffix C are taken through the compliant member 61, and having the Suffix D are taken through the seal structural member 64.

According to an exemplary embodiment, the seal 60 may be coupled to the side panel 30 prior to assembly of the shower enclosure 10. For example, the seal 60 may be inserted into the receptacle 36 at a manufacturing facility (i.e., prior to shipment to a store, installer, or consumer), or the seal 60 may be packaged or otherwise provided with or for the side panel 30 and/or entire enclosure 10. In particular, the base structure 62 is inserted into the receptacle 36 with the surface thereof (e.g., upper, outer, and/or lower) tightly engaging the inner surfaces of the receptacle to be coupled thereto (e.g., by interference-, press-, or tolerance-fit). As the base structure 62 is inserted into the receptacle 36, the compliant member 61 is simultaneously inserted into the channel or slot 35 in the lower, outwardly extending flange 33 of the side panel 30. Once the seal 60 is assembled to the side panel 30, the compliant member 61 extends through the slot 35 to below the side panel 30 (i.e., lower surface 61*a* of the compliant member is positioned below the lower, outwardly extending flange 33 of the side panel 30) and below the base structure 62. Further, the compliant member 61 may extend rearward of the receptacle 36 of the side panel 30 and the base structure 62. See, e.g., FIGS. 6A, 9, 11B, 12B, 13B, and 14B. For clarity, the leak path L is into the page in FIGS. 11A-14C.

After the seal 60 is inserted into the receptacle 36, the side panel 30 is placed into proper position on and may be coupled to the base 20. In particular, the outwardly extending flange or lower surface or end 33 of the side panel 30 is positioned on the outwardly extending flange or upper surface or ledge 23 of the base 20 along substantially the entire length of the lower flange 33 (i.e., the lower flange 33 mates with the upper ledge 23). The rear end of the lower flange 33 may be positioned proximate (or adjacent, or engaging) the rear flange 24 of the base 20. Once the side panel 30 is positioned on and or coupled to the base 20, the compliant member 61 is compressed upward by the upper ledge 23 in the channel 35 of the lower flange 33. For example, the portions of the flange 33 and/or flange 37 immediately adjacent the channel 35 contact the upper ledge in regions proximate and/or adjacent the compliant member 61. Further, the compliant member 61 may be compressed forward by the rear flange 24 of the base 20. See, e.g., FIGS. 6B, 10, 11C, 12C, 13C, and 14C.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A seal for a bathing enclosure comprising:

a compliant member having opposing first and second sides defining a plurality of apertures, the plurality of apertures extending from the first side to the second side;

a first member having an inner surface configured to engage the first side of the compliant member;

a second member having an inner surface configured to engage the second side of the compliant member;

a plurality of female members projecting from the inner surface of the first member through the plurality of apertures;

a plurality of male members projecting from the inner surface of the second member through the plurality of apertures;

wherein the male members are configured to be received in the plurality of female members.

2. The seal according to claim 1, wherein the compliant member is compressed between the first member and the second member.

3. The seal according to claim 1, wherein the seal is configured to be received in a receptacle, the receptacle having a lower flange and a side flange projecting from the lower flange.

4. The seal according to claim 3, wherein an internal segment projects from the side flange; and wherein at least one of the first member or the second member is configured to be disposed between the lower flange and the internal segment.

5. The seal according to claim 4, wherein at least one of the first member or the second member includes upper and lower surfaces;

wherein the upper surface is configured to engage the internal segment; and wherein the lower surface is configured to engage the lower flange.

6. The seal according to claim 3, wherein an upper flange projects from an upper end of the side flange; and wherein an upper surface of the compliant member is configured to be compressed by the upper flange of the receptacle.

7. The seal according to claim 3, wherein a rear flange projects from a rear end of the side flange; and wherein a rear surface of the compliant member is configured to be compressed by the rear flange of the receptacle.

8. The seal according to claim 7, wherein the compliant member is configured to be compressed between the rear flange of the receptacle and a front panel of a bathing enclosure.

9. A method of sealing a bathing enclosure comprising:

inserting a compliant member into a receptacle projecting from a side panel of a bathing enclosure;

coupling the side panel to a base of the bathing enclosure; and compressing the compliant member between a flange of the base and a first portion of the receptacle.

10. The method according to claim 9, further comprising compressing the compliant member between a rear flange of the base and a second portion of the receptacle.

11. The method according to claim 9, wherein the compliant member extends through a slot in the receptacle when it is inserted into the receptacle.

* * * * *